United States Patent [19]

Schultz et al.

[11] 4,203,405

[45] May 20, 1980

[54] PRIMER

[75] Inventors: Curtis L. Schultz, Grafton; Thomas G. Guntly, Hartford, both of Wis.

[73] Assignee: Tecumseh Products Company, Tecumseh, Mich.

[21] Appl. No.: 854,816

[22] Filed: Nov. 25, 1977

[51] Int. Cl.[2] ..... F02M 1/16

[52] U.S. Cl. ..... 123/187.5 R; 261/DIG. 8

[58] Field of Search ..... 123/187.5 R; 261/30, 261/DIG. 8

[56] References Cited

U.S. PATENT DOCUMENTS

| | | | |
|---|---|---|---|
| 3,170,006 | 2/1965 | Brown | 261/DIG. 68 |
| 3,275,305 | 9/1966 | Nutten | 123/187.5 R |
| 3,281,129 | 10/1966 | Payne | 123/187.5 R |
| 3,307,836 | 3/1967 | Arndt et al. | 123/187.5 R |
| 3,323,293 | 6/1967 | Sasti | 123/187.5 R |
| 3,345,045 | 10/1967 | Tuggle | 123/187.5 R |
| 3,430,933 | 3/1969 | Taggart | 261/DIG. 8 |
| 3,494,343 | 2/1970 | Nutten | 123/187.5 R |

*Primary Examiner*—Charles J. Myhre
*Assistant Examiner*—Andrew M. Dolinar
*Attorney, Agent, or Firm*—Albert L. Jeffers

[57] ABSTRACT

Method and apparatus for supplying a priming charge of a fuel-air mixture to a conventionally aspirated internal combustion engine is disclosed wherein a pliable primer bulb either integral with a carburetor or located remote therefrom may be operator depressed to decrease an air volume confined by that bulb forcing air from that volume into a comparatively smaller fuel well. Air flow into that fuel well forces fuel therefrom upwardly through a hollow cylindrical tube and into a constricted region in the carburetor throat to be mixed with air passing through that throat and into the engine. The tube leading from the fuel well into the constricted region or Venturi of the carburetor throat may additionally be provided with a small air hole in a side wall thereof into which additional air is injected during the priming operation to provide some initial air mixed in the fuel as that fuel is supplied to the carburetor throat. Fuel from a conventional float regulated chamber is supplied by gravity flow to replenish the fuel displaced from the priming well during the priming operation. The tube extending from the priming well into the carburetor throat may constitute the only operating jet for the carburetor.

12 Claims, 5 Drawing Figures

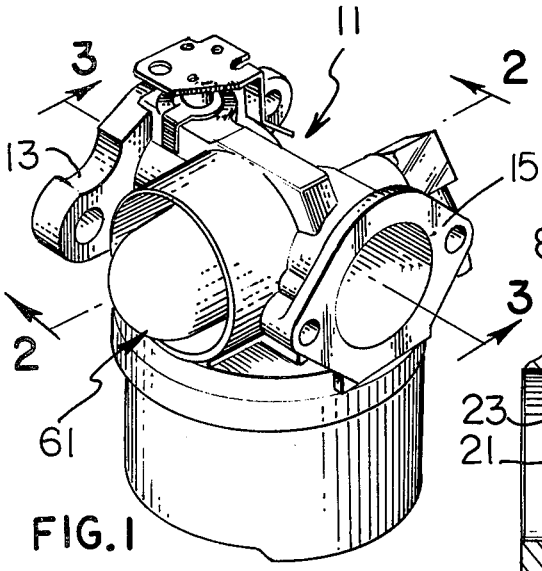
FIG. 1
FIG. 3
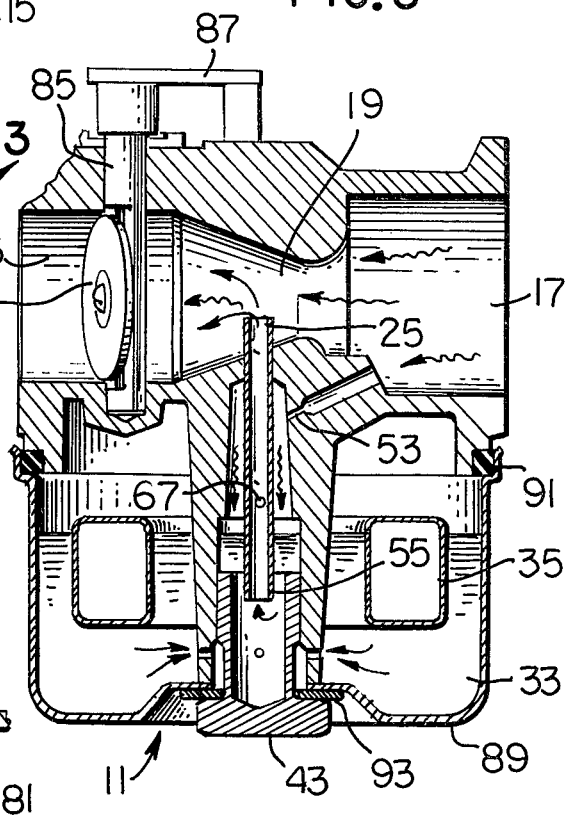
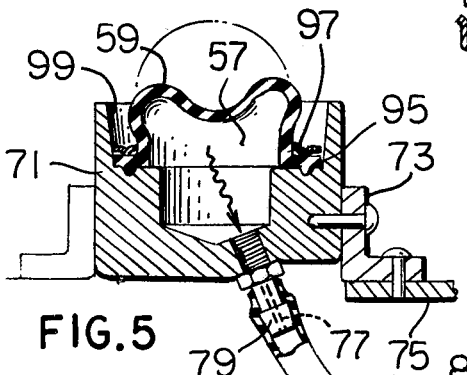
FIG. 5
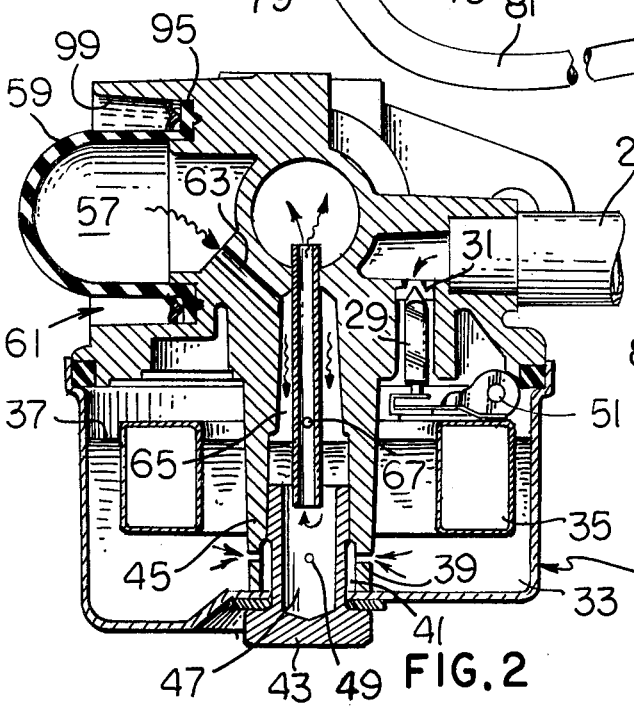
FIG. 2
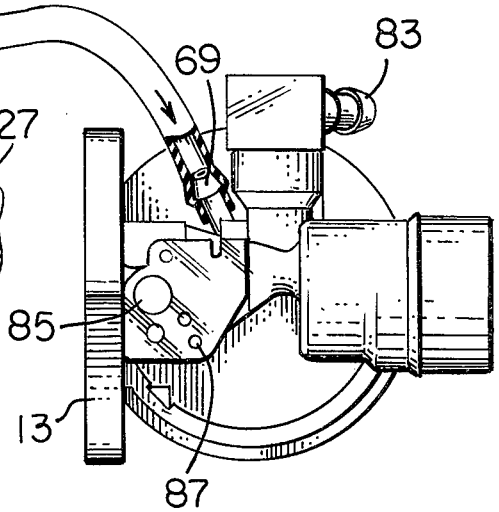
FIG. 4

PRIMER

BACKGROUND OF THE INVENTION

The present invention relates generally to the supplying of a combustible fuel-air mixture to an engine and more particularly to supplying an initial charge to an engine when attempting to start that engine. Even more specifically, the present invention relates to manually operable priming arrangements for supplying such an initial charge of fuel to an engine.

Engine priming arrangements are known in degrees of sophistication ranging from physically pouring fuel from a container down a carburetor throat to rather complicated fuel injection systems, as might be encountered for a diesel engine or for a fuel injected aircraft engine. Carburetors for a conventional automobile frequently have fuel pumps integral therewith which, when actuated, squirt a small charge of fuel directly into the carburetor throat. These conventional automotive arrangements link this pump to the accelerator pedal so that the pump squirts a fuel charge into the carburetor throat when the accelerator is rapidly depressed, smoothing acceleration if the engine is running, or supplying a priming charge for starting the engine, if the engine is not running. As most drivers are well aware, such a primer pump may be actuated several times by depressing the accelerator pedal repeatedly when attempting to start the automobile in cold weather. Fuel pump arrangements of this type have been used in conjunction with smaller engines as might be encountered on lawnmowers or garden tractors, but such pump arrangements are, of course, relatively expensive and complicated, with the cost thereof not justified for smaller and highly competitive engine environments.

It is also known in the small engine carburetion art to provide priming arrangements which do not directly handle or pump the priming fuel charge. In one such "indirect" priming arrangement, the air space overlying the fuel supply in the carburetor float chamber has the pressure thereof increased by the manual operation of a primer and this pressure increase forces fuel from the float chamber through an aperture which meters the fuel flow during normal running operation and thence into a so-called nozzle tube which communicates with the Venturi region of the carburetor throat supplying the priming charge to this region. Cranking the engine then pulls air through the Venturi region to be mixed with the priming fuel charge and supplied to the engine during the starting process. While representing an improvement over the "direct" primers where a pump arrangement handles the fuel directly with the resulting problems of moving seals and material deterioration due to contact with the seals, primers where the air space over the float chamber is pressurized to induce a priming charge into the carburetor throat suffer from a number of drawbacks. The float bowl and therefore also the air space above the fuel supply therein must be reasonably large to meet the fuel requirements of the engine, provide an adequate float and space therefor, and be vented somehow to atmospheric pressure for proper operation. With these constraints a relatively large volume of air must be rapidly displaced into the region atop the fuel in the float bowl to displace sufficient fuel rapidly into the carburetor throat to effect the priming operation. Also, a charge of pure fuel is supplied to the carburetor throat with such systems, whereas some initial mixing of air and fuel prior to supplying such a mixture to the carburetor throat would be desirable in order to obtain a good combustible priming charge. Still further in such arrangements both priming and running fuel must pass through the same fuel metering aperture which leads from the fuel bowl to the fuel jet. On priming such a metering aperture necessarily limits both the quantity and force with which the priming charge is introduced.

SUMMARY OF THE INVENTION

Among the several objects of the present invention may be noted the provision of a manually operable primer for a small engine carburetor; the provision of a primer, the moving parts of which do not directly contact the fuel; the provision of a priming arrangement which introduces a fuel-air mixture as the priming charge into the throat of a carburetor; the provision of a priming arrangement readily adapted for direct mounting on a carburetor or mounting remote from that carburetor; the provision of a carburetor priming arrangement characterized by its ease and economy of manufacture; and the provision of a priming arrangement having a rapid response, adequate charge, and a charge which, when presented to the carburetor throat, already contains some air mixed with the fuel. These as well as other objects and advantageous features of the present invention will be in part apparent and in part pointed out hereinafter.

In general a method of supplying an initial fuel-air charge to a conventionally carbureted internal combustion engine for starting that engine according to the present invention includes the displacing of a volume of air from a first or priming chamber into a second smaller chamber which overlies a small quantity of fuel which in turn displaces fuel from that small quantity through a hollow cylindrical tube or nozzle into the carburetor throat. The displacing operations occur relatively rapidly and thereafter and more slowly the displaced fuel is replenished by gravity fuel flow from a float regulated fuel supply chamber. A small quantity of air may be admitted into the tube along with the displaced fuel before the fuel enters the carburetor throat. Typically, the priming chamber includes a flexible substantially air impervious member and the initial displacing is caused by manual depression of that flexible member with the resilience of that member returning the priming chamber volume to its initial value after the priming operation and equalization of the pressures within the two chambers to atmospheric pressure occurring slowly after the priming operation while the displaced fuel is being replenished.

Also in general and in one form of the invention, an improvement for providing an initial charge of a fuel-air mixture to an internal combustion engine for engine starting purposes includes within an otherwise somewhat standard carburetor, a variable volume chamber with operator actuable means for decreasing the volume of that chamber and a conduit interconnecting the chamber with a fuel or priming well within the carburetor which is gravity fed from a float operated carburetor fuel supply chamber. The conduit allows air to pass from the variable volume chamber to the well to in turn urge fuel from that well through means for supplying fuel to the engine to provide the priming charge. The operator actuable means is biased to return the chamber volume to its predecreased value after the priming operation and without drawing fuel from the fuel well into the variable volume chamber. The means for supplying fuel from the well to the carburetor throat may include an elongated generally cylindrical hollow tube having one end thereof normally immersed in the fuel within the well and the other end thereof extending from the well and into the air path and generally the Venturi portion thereof through the carburetor and to the engine. The tube may be provided with a small air passing aperture through a side wall thereof disposed above the fuel level to allow air to enter the tube and mix with the fuel passing therethrough. A pliable dome element may be employed as part of the variable volume chamber and disposed either integral with the carburetor or remote therefrom but in either case easily operator accessible for engine starting.

BRIEF DESCRIPTION OF THE DRAWING

FIG. 1 is a perspective view of a small engine carburetor having a primer according to the present invention integral therewith;

FIG. 2 is a sectional view along the line 2—2 of FIG. 1;

FIG. 3 is a sectional view along the line 3—3 of FIG. 1;

FIG. 4 is a top view of a carburetor including a primer according to the present invention with that primer located in part remote from the carburetor; and FIG. 5 illustrates in cross-section the remote part of the primer arrangement used in conjunction with FIG. 4.

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENTS

Referring now to the drawings in general, a carburetor 11 provides a combustible fuel-air mixture to a conventionally aspirated internal combustion engine having, for example, flange 13 bolted either directly to the engine or to an intake manifold thereof. Air is supplied to the carburetor from, for example, an air cleaner bolted to the flange 15, and that air passes into an initial portion of the carburetor throat 17, through the Venturi portion of the carburetor throat 19, past butterfly or throttle control valve 21, exiting from the carburetor throat portion 23 to the engine. As the air passes through the Venturi region 19 of the carburetor throat, the pressure thereof decreases, drawing fuel into the air flow stream from the carburetor jet or nozzle 25.

Fuel is supplied to the carburetor by fuel line 27 by gravity flow or by way of a fuel pump from a fuel supply tank and passes by way of a needle valve, including the needle 29 and seat 31, into fuel supply chamber 33, having an annular float 35 disposed therein for controlling needle 29 and therefore also the level, such as 37, of the fuel within the regulated supply chamber. Fuel passes slowly by gravity from the regulated supply chamber 33 through one or more fill orifices, such as 39, into region 41 disposed between bowl nut 43 and the hollow columnar portion 45 of the carburetor which separates the fuel bowl 33 from the fuel priming well 47. One or more metering holes 49 in the bowl nut 43 allow the fuel to pass from the intermediate region 41 into the priming well 47. Fuel in the priming well 47 and fuel in the fuel bowl 33 seeks its own level by gravity flow and if this level, such as at 37, is inadequate, float 35 is pivoted downwardly somewhat about pivot pin 51, allowing a gap between the float valve needle 29 and needle seat 31, whereupon fuel flows inwardly from pipe 27 to fill the fuel bowl 33 and therefore also the priming well 47 to its preferred level, whereupon the needle valve 29, 31, shuts off further fuel flow. During normal engine operation, air flow past the nozzle 25 is at a pressure lower than atmospheric pressure, whereas the pressure in the air chamber above the fuel in fuel well 47 is at essentially atmospheric pressure due to the pressure equalizing opening 53, which is a relatively small opening connecting the inlet area 17 of the carburetor throat with the upper portion of well 47. This pressure differential forces fluid upwardly through the lower end 55 of the nozzle or hollow cylindrical tube and that fuel enters into the air stream and is mixed therewith to provide the fuel-air mixture to the engine during this normal running operation. During cranking of the engine to start that engine, this same air flow and pressure differential occurs to a much lesser extent and often a good charge of fuel for starting is not achieved and to improve this starting fuel charge, the priming arrangement of the present invention is employed.

A variable volume chamber 57 is formed by sealingly seating a flexible air impervious bulb or dome 59 in a pocket or hole 61 in the carburetor housing. The natural resilience of the bulb, which may for example be of a rubber-like material, causes the bulb to assume the configuration illustrated in FIGS. 1 and 2, however, an operator may actuate the priming arrangement by depressing bulb 59 to decrease the volume of the variable volume chamber 57. Decreasing the volume of chamber 57 forces a portion of the air therein through the conduit 63 and into the air space 65 overlying the fuel contained within the priming well 47. This in turn increases the air volume in the region 65, forcing fuel into the immersed end 55 of the fuel nozzle upwardly through that nozzle and out of the nozzle end or jet 25 into the carburetor throat. A pressure differential caused by engine cranking moves this displaced fuel into the engine combustion chamber as a priming charge for starting the engine. The conduit 63 is of substantially greater cross-sectional area than the pressure equalizing vent 53 or metering holes 49, so that a relatively rapid depression of the dome 59 squirts fuel through the nozzle and into the carburetor throat without substantial priming defeating leakage occurring, either through the pressure equalizing vent 53 or the metering hole, such as 49.

When the operator releases bulb 59, its natural resilience functions to bias it toward its normal at rest position illustrated in FIG. 2, thereby to return the volume of chamber 57 to its predecreased value. This action, of course, draws air from the region 65 back into the variable volume chamber, but without drawing fuel from the well 47 into that chamber since the air required to refill chamber 57 flows through the equalizing opening 53 into the annular region 65, and thence by way of conduit 63 into chamber 57.

Between the end of nozzle tube 25 and the immersed end 55 of the hollow cylindrical tube, the pressure drops from substantially that within the region 65 above the fuel, to that within the Venturi portion 19 of the carburetor throat. Thus, the pressure within the nozzle tube in the region of the small air hole 67 is lower than the pressure in the air space 65 overlying the fuel in the well, and air enters from this region 65 into the nozzle tube, both during the priming operation and during normal engine running. During priming this air introduced through the air opening 67 aids in dispersing the priming charge and mixing it with air to provide a more combustible priming charge to the engine.

Considering now the modification wherein the variable volume chamber is located remote from the main carburetor, for example to make the primer bulb more accessible to the operator, as illustrated in FIGS. 4 and 5, it will be noted that a nipple 69 extends from the top of the carburetor, as viewed in FIG. 4, which nipple 69 has an opening therein communicating with a conduit, such as 63, discussed in conjunction with the previous Figures, and with the remaining carburetor internal portions unchanged from those Figures, except for the absence of the variable volume chamber 57 and associated bulb 59.

The variable volume chamber 57 has been moved to any convenient remote location, such as illustrated in FIG. 5, where the chamber housing 71 is mounted, for example by a bracket 73 to, for example the engine frame 75 or other available convenient locations. While bulb 59 is illustrated in FIGS. 1 and 2 in its natural rest position, bulb 59 is illustrated in FIG. 5 as it would appear when depressed by an operator. In this depressed position, part of the air is displaced from chamber 57 into a conduit 77, which connects by way of nipple 79 to a flexible tube 81. The end of tube 81 remote from that illustrated in FIG. 5 of course connects to the nipple 69 or other fitting on the carburetor. In other respects, the modification of FIGS. 4 and 5 operates substantially as previously described.

The carburetor in both illustrated versions includes a number of further substantially conventional features. Fuel supply line 27 may, as illustrated in FIG. 4, be connected to a further nipple 83 for connecting by a flexible line to the fuel supply. Butterfly valve 21 is mounted on a rod 85 for actuation by an external lever 87 to open and close the carburetor throat, thereby controlling engine speed. The fuel bowl 33 may be formed of a rather thin sheet metal stamped cup 89, sealing to the lower periphery of the main portion of the carburetor about an annular region filled with an annular gasket 91. Such a fuel bowl shell would typically be fastened to the remaining carburetor portion by the bowl nut 43, and a further washer-like gasket 93 included between the bowl nut and bowl shell to complete the sealing of the fuel bowl.

A complete understanding of the present invention does not require any further elaboration on the particular manner in which the primer bulb 59 is sealingly engaged with the remote or carburetor pockets to form the variable volume chamber 57. For example, the annular rim 95 of the bulb or dome could attach to the surface by employing adhesives of known types. A unique approach for sealingly disposing the primer bulb within the pocket employing a metallic locking ring 97 is disclosed and claimed in copending application Ser. No. 854,815 assigned to the assignee of the present invention, and filed on even date herewith. Briefly, ring 97 bites into the tapering wall portion 99 to securely hold rim 95 in contact with an annular groove in the pocket, as more fully disclosed in the aforementioned copending application.

From the foregoing it is now apparent that a novel process for supplying a priming charge of fuel to an internal combustion engine as well as a novel carburetor priming apparatus has been disclosed meeting the objects and advantageous features set out hereinbefore as well as others and that modifications as to the precise configurations, shapes and details, as well as the precise steps of the method may be made by those having ordinary skill in the art without departing from the spirit of the invention or the scope thereof as set out by the claims which follow.

What is claimed is:

1. The method of supplying an initial charge of fuel-air mixture to a conventionally carbureted internal combustion engine for the purpose of starting that engine comprising:

providing a quantity of fuel within a float regulated fuel supply chamber, providing a priming fuel chamber within the float regulated chamber, the priming fuel chamber containing a small quantity of fuel and a volume of air overlying the small quantity of fuel, providing a conduit disposed within and extending upwardly from the surface of the fuel and surrounded by the volume of air in the priming fuel chamber, manually and abruptly displacing a discrete volume of air from a variable volume chamber, by decreasing the volume thereof, into the priming fuel chamber at a point over the surface of the fuel in the priming fuel chamber so as to displace a discrete quantity of fuel from the priming fuel chamber into the throat of the carburetor in response to an increase in the priming fuel chamber air volume caused by the entry of the air from the variable volume chamber, the volume of air in the priming fuel chamber being less than the volume of the variable volume chamber, and replenishing the displaced fuel in the second chamber by gravity fuel flow from the float regulated fuel supply chamber.

2. The method of claim 1 comprising a further step of admitting a small quantity of air from the priming fuel chamber air volume into the displaced fuel before that displaced fuel enters the carburetor throat.

3. A method of claim 1 wherein the variable volume chamber is formed in part of a flexible substantially air impervious member, and including the step of displacing a volume of air from that variable volume chamber including manually depressing the flexible member.

4. The method of claim 1 including the additional step of equalizing the pressures within the variable volume chamber and the air volume in the priming fuel chamber to atmospheric pressure while the displaced fuel is being replenished.

5. The method of claim 4 wherein the time taken to equalize the pressures and replenish the fuel is substantially longer than the time required to displace air from the first chamber and to displace fuel into the carburetor throat.

6. A carburetor for providing a combustible fuel-air mixture to a conventionally aspirated internal combustion engine comprising:

a float regulated fuel supply chamber, a fuel well within the float regulated chamber and gravity fed from the float regulated chamber, said fuel well having a smaller volume that the float regulated chamber, a float mechanism within said float regulated chamber for maintaining a predetermined fuel level in said float regulated chamber and said fuel well, conduit means disposed within and extending upwardly from below to above the fuel level in said fuel well for conveying fuel from the fuel well to air passing through the carburetor and into the engine during normal engine operation, a portion of said conduit means above the fuel level in the fuel well being surrounded by a volume of air, an air filled variable volume chamber having a normal volume larger than the volume of said fuel well above the fuel level thereof, operator actuable means for abruptly displacing a discrete volume of air therefrom, a passageway interconnecting the variable volume chamber and the well above the fuel level whereby a decrease in the chamber volume forces air into the well so as to abruptly lower the fuel level therein and force fuel from the well upwardly through the conduit means, and means biasing the operator actuable means to return the variable chamber volume to its predecreased volume without drawing fuel from the well into the variable volume chamber.

7. The carburetor of claim 6 wherein said conduit means comprises an elongated generally cylindrical hollow tube having one end thereof normally immersed in the fuel within the fuel well and at the other end thereof extending from the fuel well and into the path of air passing through the carburetor and into the engine.

8. The carburetor of claim 7 wherein the hollow tube has a small air passing aperture through a sidewall of the tube disposed above the level of fuel in the fuel well to allow air to enter the tube and mix with the fuel passing therethrough.

9. The carburetor of claim 7 wherein the air path through the carburetor to the engine includes a constricted region in which the pressure during normal engine operation is less than and in atmospheric pressure, the tube other end extending into the constricted region and forming the only operating jet in the carburetor.

10. The carburetor of claim 6 wherein the operator actuable means comprises a pliable dome member with the interior thereof forming a portion of the variable volume chamber and a natural resilience thereof comprising the means biasing the operator.

11. The carburetor of claim 10 wherein the variable volume chamber is formed in part by a pocket in the carburetor, the dome members sealingly engaging the pocket and extending therefrom to the operator accessible, and the said passageway extending from the pocket to the fuel well.

12. The carburetor of claim 6 wherein the variable volume chamber and operator actuable means are located remote from the carburetor with said passageway comprising a tube extending from the chamber to the carburetor.

* * * * *

UNITED STATES PATENT AND TRADEMARK OFFICE

CERTIFICATE OF CORRECTION

PATENT NO. : 4,203,405

DATED : May 20, 1980

INVENTOR(S) : Curtis L. Schultz and Thomas G. Guntly

It is certified that error appears in the above-identified patent and that said Letters Patent are hereby corrected as shown below:

Claim 6, Col. 6, Line 67 "that" should be -- than --.

Claim 10, Col. 8, line 19 "actuable means" should be inserted after "operator"

Claim 11, Col. 8, line 4 "the" should be -- be --.

Signed and Sealed this

*Seventh* Day of *October 1980*

[SEAL]

*Attest:*

SIDNEY A. DIAMOND

*Attesting Officer*

*Commissioner of Patents and Trademarks*